US006883584B2

(12) United States Patent
Grober et al.

(10) Patent No.: US 6,883,584 B2
(45) Date of Patent: Apr. 26, 2005

(54) METHOD FOR CONTINUOUSLY CASTING A STEEL BEAM BLANK

(75) Inventors: Henri Grober, Esch-sur-Alzette (LU); Boris Donnay, Nandrin (BE); René Creutz, Volmerange-les-Mines (FR); Pierre Michels, Sanem (LU); Marc Mertens, Soleuvre (LU); Charles Prum, Mondercange (LU); Marc Klees, Differdange (LU); Nicolas Bonifas, Nospelt (LU)

(73) Assignee: ProfilARBED S.A., Luxembourg (LU)

( * ) Notice: Subject to any disclaimer, the term of this patent is extended or adjusted under 35 U.S.C. 154(b) by 0 days.

(21) Appl. No.: 10/487,295

(22) PCT Filed: Jul. 30, 2002

(86) PCT No.: PCT/EP02/08468

§ 371 (c)(1),
(2), (4) Date: Feb. 20, 2004

(87) PCT Pub. No.: WO03/018230

PCT Pub. Date: Mar. 6, 2003

(65) Prior Publication Data

US 2004/0194907 A1 Oct. 7, 2004

(30) Foreign Application Priority Data

Aug. 20, 2001 (LU) ..... 90819

(51) Int. Cl.[7] ..... B22D 11/04; B22D 11/12

(52) U.S. Cl. ..... 164/476; 164/459; 164/486

(58) Field of Search ..... 164/476, 477, 164/484, 486, 442, 418, 459

(56) References Cited

U.S. PATENT DOCUMENTS 4,805,685 A * 2/1989 Lorento ..... 164/418
5,247,988 A * 9/1993 Kurzinski ..... 164/485
5,630,467 A * 5/1997 Yoshimura et al. ..... 164/486

FOREIGN PATENT DOCUMENTS

JP 10263752 6/1998

* cited by examiner

*Primary Examiner*—Kevin P. Kerns
(74) *Attorney, Agent, or Firm*—McCormick, Paulding & Huber LLP

(57) ABSTRACT

A method for producing a steel beam blank includes continuously casting a steel beam blank strand and cooling the steel beam blank strand in a secondary cooling zone. The steel beam blank strand is guided in a vertical casting plane along a curved path having its web perpendicular to the vertical casting plane, so that each of the lateral flanges has an intrados flange tip and an extrados flange tip. The method further includes straightening the steel beam blank strand behind the secondary cooling zone. When being straightened, the intrados flange tips are selectively reheated between the secondary cooling and the straightening of the steel beam blank strand via an external energy supply focused on the intrados flange tips. In this manner, transverse cracks in the intrados flange tips may be reliably avoided.

10 Claims, 4 Drawing Sheets

METHOD FOR CONTINUOUSLY CASTING A STEEL BEAM BLANK

CROSS-REFERENCE TO RELATED APPLICATIONS

This application is entitled to the benefit of and incorporates by reference in their entireties essential subject matter disclosed in International Application No. PCT/EP02/08468 filed on Jul. 30, 2002 and Luxembourg Patent Application No. 90819 filed on Aug. 20, 2001.

FIELD OF THE INVENTION

The present invention relates to a method for continuously casting a steel beam blank.

BACKGROUND OF THE INVENTION

Since the 1960s it is known in the art of steel making to continuously cast near-net-shape sections for rolling e.g. I-beams or H-beams. These near-net-shape sections are called beam blanks. They have a substantially H-shaped cross-section with a web centrally arranged between two lateral flanges. Today such beam blanks are even used to roll Z-shaped sheet-piles and other steel sections.

Beam blanks are produced by continuous casting, i.e. liquid steel is continuously fed into a short, water-cooled copper mould with an open vertical casting channel, and a beam blank strand, which has the final cross section of the beam blank to be produced, is continuously withdrawn from this mould. At the outlet of the continuous casting mould the continuous beam blank strand has only a thin solidified outer shell enveloping a liquid steel core. Solidification of the beam blank strand is then continued by spray cooling, wherein a cooling fluid, generally water or an air-water-mist, is sprayed onto the perimeter surfaces of the beam blank strand. This spray cooling takes place in a secondary cooling zone beneath the continuous casting mould. In this secondary cooling zone the beam blank strand is guided in a vertical casting plane along a curved path, with its web being perpendicular to the vertical casting plane. An extraction and straightening device, which is located downstream of the secondary cooling zone, straightens the bent beam blank strand, prior to pushing it onto a horizontal run-out table, where beam blanks of a desired length are cut from the continuous beam blank strand.

It is well known in the art of continuous casting that a good control of the secondary cooling of the strand is of utmost importance for the final quality of the cast product. It is indeed this secondary cooling that allows to control temperature evolution in the strand during its final solidification, thereby allowing to control the microstructure of the cast product.

While spray cooling in the secondary cooling zone of a continuous casting line allows a rather good control of temperature evolution during solidification of billets, blooms or slabs, this is not yet the case for beam blanks. Indeed, due to the fact that beam blanks have—in comparison with billets, blooms and slabs—a relatively complex cross-section (comprising elements of different thickness, orientation and perimeter surface to volume ratio), it is very difficult to closely control the evolution of the temperature profile in a beam blank by spray cooling. A more or less uniform spray cooling of all the perimeter surfaces of the beam blank will for example inevitably result in an over-cooling of the flanges. However, trying to avoid an over-cooling of the flanges by reducing direct spray cooling of the flange surfaces, results in an insufficient cooling of the massive joining portions between the flanges and the web, which still enclose important liquid steel pockets. The consequence of an insufficient cooling of this liquid steel pockets is a bulging of the shell in the flange/web joining portions due to the internal pressure in the liquid steel pockets and an increased risk of a liquid steel break-through. In conclusion, optimising the secondary cooling of a beam blank is a rather complex problem, which has already been and still is the object of numerous research programs. However, despite the use of sophisticated computer programs for selectively controlling spray cooling of the different zones of the beam blank in function of various casting parameters, present beam blanks still tend to have major shortcomings.

One of these shortcomings of present beam blanks is the presence of transverse cracks in the intrados flange tips. These transverse cracks appear in the intrados flange tips when the beam blank is straightened in the straightening device. They are observed in particular, but not exclusively, in large section and high strength beam blanks. Although it is very likely that these transverse defects are due to an undesired quench of the flange tips during secondary cooling, it has not yet been possible to reliably avoid these cracks, e.g. by a better control of the secondary spray cooling. In this context it has to be pointed out that it is particularly problematic to control secondary cooling of the intrados flange tips, because these flange tips are not only cooled by the cooling fluid that is directly sprayed onto the intrados portions of the flanges, but also by the cooling fluid that is sprayed onto the intrados side of the web and of the web/flange joining portions. Indeed, at least part of this intrados cooling fluid flows laterally over the intrados flange tips, thus causing an undesired vigorous cooling of the latter. In order to reduce risk of quenching the flange tips, spray cooling of the intrados side of the beam blank strand should therefore be generally limited, but this would result in other problems, as e.g. a bulging of the shell on the intrados side of the flange/web joining portions.

JP-A-10263752 is concerned with the prevention of warping at the flange part during the continuous casting of beam blanks. To prevent this flange warping this document suggests to eliminate the temperature difference between the flange surfaces and the last solidified part of the beam blank by heating the flange surfaces of the beam blank up to 900–950° C. until the beam blank reaches final solidification or shortly thereafter. The Japanese document contains however no teaching about avoiding transverse cracks in the intrados flange tips during the straightening of the beam blank.

OBJECTS AND SUMMARY OF THE INVENTION

A technical problem underlying the present invention is consequently to reliably avoid the formation of transverse cracks in the intrados flange tips during straightening of a beam blank while nevertheless warranting a sufficient secondary cooling of the intrados side of the beam blank.

A method for producing a steel beam blank in accordance with the present invention comprises the known steps of:

continuously casting a steel beam blank strand with an H-shaped cross-section having a central web between two lateral flanges;

cooling the steel beam blank strand in a secondary cooling zone, wherein the steel beam blank strand is guided in a vertical casting plane along a curved path having its web perpendicular to the vertical casting plane, so that each of the lateral flanges has an intrados flange tip and an extrados flange tip each of the intrados flange tips presenting an intrados border surface;

straightening the steel beam blank strand behind the secondary cooling zones; and providing an external energy supply to the flanges been the cooling in said secondary cooling zone and the straightening of the steel beam blank strand.

In accordance with an important aspect of the present invention, the external energy supply is focused on each of the intrados flange tips, more particularly on a boundary zone immediately beneath the intrados border surface, so as to selectively reheat this boundary zone before the straightening of the steel beam blank stand. It has indeed been discovered that such a focused reheating allows to obtain a remarkable recovery of hot ductility of the steel in the flange tips, which is sufficient to reliably avoid the appearance of transverse cracks during straightening of the beam blank strand. It will be appreciated in this context, that the method of the present invention allows to design and optimise the secondary cooling of the intrados side of the beam blank strand, without paying too much attention to a quench of the flange tips. Indeed, In accordance with the present invention the negative effects of such a quench of the flange tips are cured thereafter by means of the selective reheating of the flange tips between the secondary cooling and the straightening of the steel beam blank strand.

In most cases it will be sufficient to determine the external energy supply so as to obtain reheating temperatures higher than 650° C., preferably higher than 800° C., in a boundary zone up to a depth of 10 mm to 20 mm beneath an intrados border surface of the flange tip. This external energy supply, should further be determined so as not to exceed temperatures of 1000° C. within the intrados flange tips.

Furthermore, it is recommended that straightening of the beam blank shall take place when the reheated intrados flange tips still have temperatures higher than 650° C., preferably higher than 700° C.

Viewed from the metallurgical point of view, it can be concluded that it is of advantage if the external energy supply is determined so as to obtain, beneath the intrados border surface, a fine grained ferrite-pearlite structure with a thickness of about 10 mm to 20 mm.

The external energy supply is easily achieved by relatively simple burner means comprising a plurality of burner nozzles aligned along the intrados flange tips.

Induction heating necessitates more sophisticated equipment, but also allows better control of the reheating operation. In case of induction heating, inductor means are arranged along the intrados flange tips, as to induce eddy currents in the intrados flange tips. According to a first embodiment, the inductor means is located above the intrados border surface and generates an alternating magnetic field penetrating through the intrados border surface into the flange tips. According to a second embodiment, the inductor means defines an air gap, and the intrados flange tip is located within the air gap in a transverse alternating magnetic field.

In order to achieve a good thermal efficiency of the reheating operation, it is recommended to carry it out under a heat insulating hood.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 2:
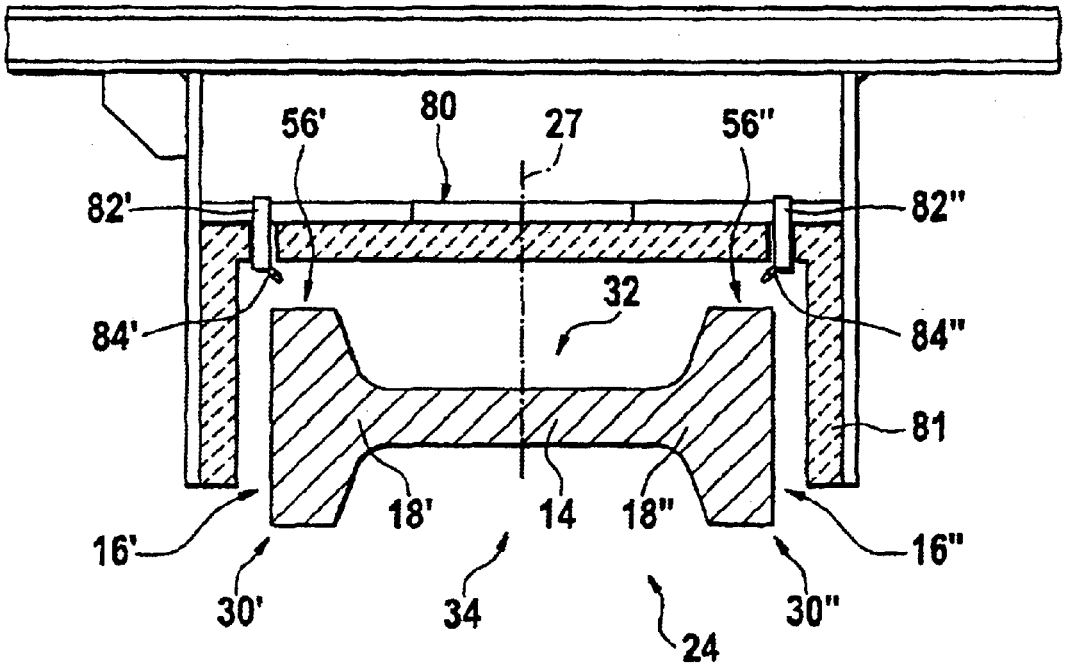
FIG. 2: is a section through the heating device of the continuous casting line of FIG. 1, with a typical large section beam blank therein.

As best seen in FIG. 2, a typical steel beam blank, which is used e.g. for rolling e.g. I-beams or H-beams, but also for rolling Z-shaped sheet piles, has a substantially H-shaped cross-section, with a web 14 that is centrally arranged between two lateral flanges 16', 16". Massive joining portions 18', 18" connect the web 14 to the lateral flanges 16', 16".

Figure 1:
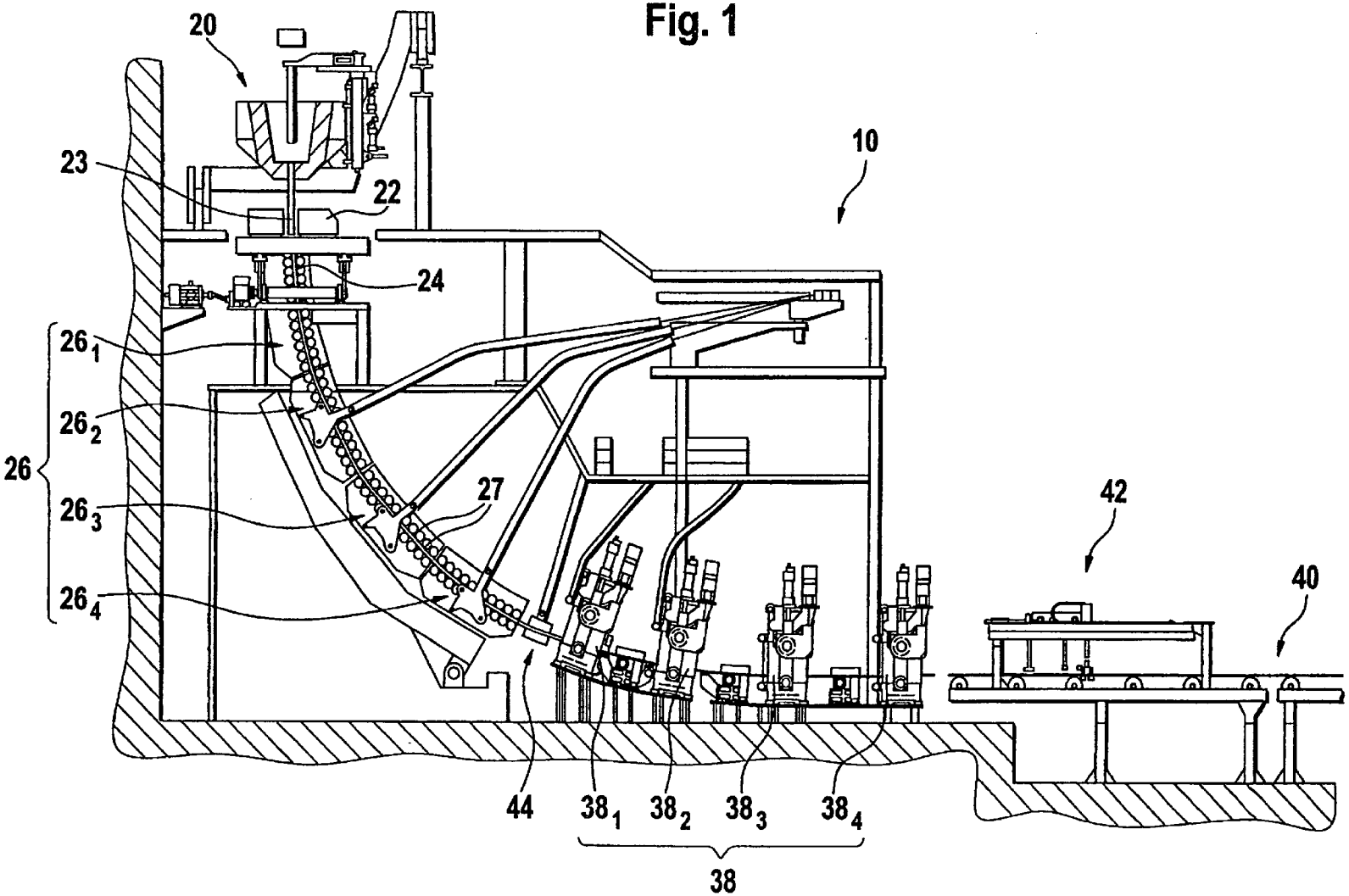
FIG. 1: is a section through a continuous casting line with a curved secondary cooling path and a heating device located at the outlet of the curved cooling path for selectively heating the intrados flange tips of the flanges of the beam blank prior to straightening the latter.

FIG. 1 shows a continuous casting line 10 for producing such steel beam blanks using a process in accordance with the present invention. In a manner known per se, a refractory-lined liquid steel distributor 20, generally called tundish, continuously feeds liquid steel into a short, water-cooled casting mould 22 with an open vertical casting channel 23. A beam blank strand 24 is continuously withdrawn from this casting mould 22. At the outlet of the continuous casting mould 22, the beam blank strand 24 has a thin solidified outer shell, which already has the final form of the beam blank to be produced, but still has liquid steel pockets therein.

Solidification of the beam blank strand 24 is then continued by spray cooling, wherein a cooling fluid, generally water or an air-water mist, is sprayed onto the perimeter surfaces of the beam blank strand 24. (It will be noted that the wording "spray cooling" used herein covers classical spray cooling as well as the so-called "air mist cooling".) This spray cooling takes place in a secondary cooling zone 26 beneath the continuous casting mould 22. Herein, the beam blank strand 24 is guided along a curved path in a vertical casting plane (i.e. the plane of FIG. 1). In the continuous casting line 10 shown in FIG. 1, the secondary cooling zone 26 consist of four guiding and spray cooling segments $\mathbf{26}_1$, $\mathbf{26}_2$, $\mathbf{26}_3$ and $\mathbf{26}_4$. Each of these guiding and cooling segments $\mathbf{26}_1$ . . . $\mathbf{26}_4$ comprises a plurality of guiding and support rollers 27 and spray means (not represented). The guiding and support rollers 27 co-operate to define the curved path for the beam blank strand 24.

Referring now to FIG. 2, wherein the vertical casting plane containing the curved centreline of the beam blank 24 is indicated with a dotted line 27, it is seen that the curved beam blank strand 24 has its web 14 perpendicular to the vertical casting plane 27. Consequently, each of the two flanges 16', 16" of the curved beam blank strand 24 has an intrados flange tip 28', 28" and an extrados flange tip 30', 30". The intrados side of the curved beam blank strand 24 is hereinafter identified with reference number 32, and its extrados side with reference number 34.

Referring back to FIG. 1, it will be noted that reference number 38 globally identifies an extraction and straightening unit, comprising e.g. four extractors $\mathbf{38}_1$, $\mathbf{38}_2$, $\mathbf{38}_3$, $\mathbf{38}_4$ which straighten the bent beam blank strand 24 and finally guide it onto a horizontal run-out table 40. On this run-out table 40, oxyacetylene torches 42 cut out beam blanks of a desired length of the continuous beam blank strand 24. A heating device 44 is arranged between the secondary cooling zone 26 and the extraction and straightening unit 38. In accordance with the method of the present invention, this heating device 44 is used to selectively heat the intrados flange tips 28', 28" of the curved beam blank strand 24 before the latter is straightened in the extraction and straightening unit 38.

Figure 5:
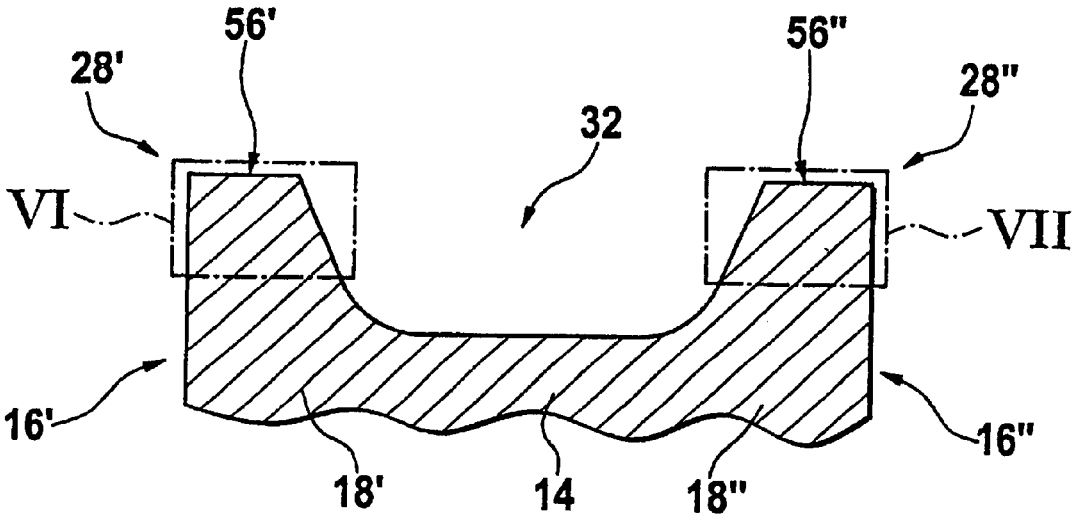
FIG. 5: is a transverse section showing the intrados half of a beam blank (the extrados half is not represented)

Before describing in greater detail preferred embodiments of the heating device 44, the effects, characteristics and advantages of this selective heating of the intrados flange tips 28', 28" of the flanges 16', 16" will now be described, inter alia with reference to FIGS. 5, 6 and 7.

It has been discovered that during the spray cooling of the beam blank strand 24 in the secondary cooling zone 26, the intrados flange tips 28', 28" are not only cooled by the cooling fluid that is directly sprayed onto the intrados portions of the flanges 16', 16", but also by the cooling fluid that is sprayed onto the intrados side 32 of the web 14 and of the web/flange joining portions 18', 18". Indeed, at least part of this cooling fluid flows laterally over the intrados flange tips 28', 28", thus causing an undesired vigorous cooling of the latter, with the result that they have a quenched microstructure when the beam blank strand 24 leaves the secondary cooling zone 26. In FIGS. 6 and 7, lines 50' and 50" indicate the boundary between a quenched microstructure zone 52', 52" above the lines 50', 50" and an equiaxed ferrite-pearlite microstructure 54', 54" below the lines 50' and 50".

At the outlet of the secondary cooling zone 26, the quenched microstructure zones 52', 52" extend from the lines 50', 50" to the intrados border surfaces 56', 56" of the intrados flange tips 28', 28", and the temperatures in these zones are generally in the range of 550° C. to 650° C. It has been discovered that, in this temperature range, the residual ductility of the steel in the quenched zones of the intrados flange tips 28', 28" is particularly low, which explains the appearance of transverse cracks in the intrados flange tips 28', 28" during the subsequent straightening of the beam blank strand 24.

In accordance with the present invention, the intrados flange tips 28', 28" are selectively reheated to temperatures higher than 650° C., preferably higher than 800° C., prior to the straightening of the beam blank strand 24. It will be appreciated that with a reheating of the flange tips 28', 28" to temperatures in the range of 650° C.–750° C., i.e. a temperature range generally still too low to achieve a significant transformation of the quenched microstructure into a ferrite-pearlite microstructure, an already remarkable recovery of hot ductility can be observed. If a reheating of the flange tips 28', 28" to temperatures in the range of 750° C. to 900° C. is achieved, a transformation of the quenched microstructure into a ferrite-pearlite microstructure takes place. For lower temperatures in this range, the transformation of the quenched microstructure is only partial, but with higher temperatures it gets more and more complete, until a fine normalised ferrite-pearlite microstructure is finally obtained. Reheating of the flange tips to temperatures higher than 1000° C. should be avoided, because such high temperatures favour an undesired grain growth.

Figure 6:
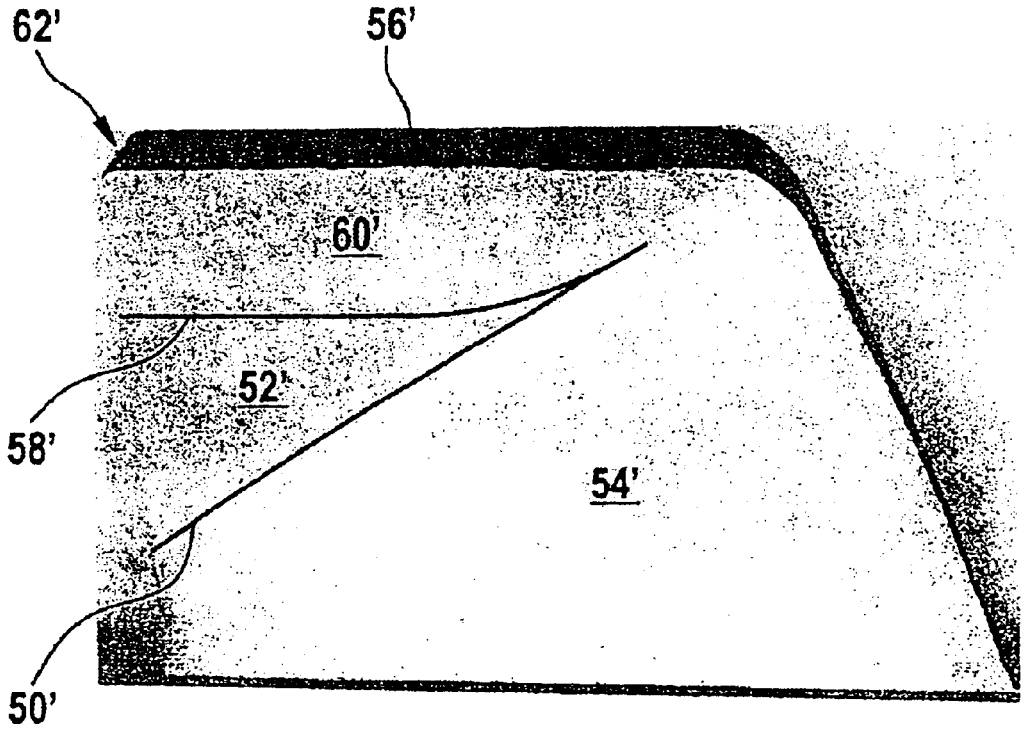
FIG. 6: is a photography of a transverse section through the terminal portion of the left beam blank flange, illustrating the boundaries between the different metallurgical structures in this section (the area shown on the photography is identified by a dotted frame in FIG. 5)
Figure 7:
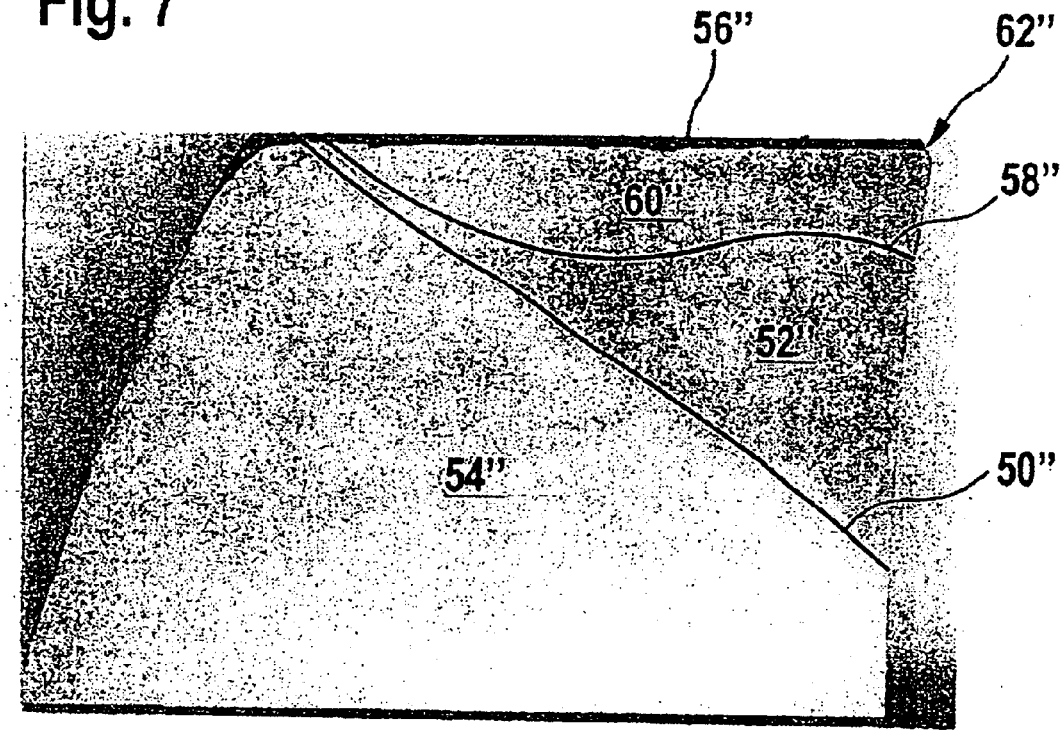
FIG. 7: is a photography of a transverse section through the terminal portion of the right beam blank flange, illustrating the boundaries between the different metallurgical structures in this section (the area shown on the photography is identified by a dotted frame in FIG. 5)

In FIGS. 6 and 7, the lines 58', 58" indicate the boundary between the original quenched microstructure zone 52', 52" at the outlet of the secondary cooling zone 26 and a zone 60', 60" in which reheating has transformed the quenched microstructure in a fine ferrite-pearlite+acicular ferrite microstructure. It will be noted that the zones 60', 60" have near the outer edge 62', 62" of the flange 16', 16" only a thickness of about 10 mm to 20 mm, i.e. only about 30% to 40% of the thickness of the quenched zone 52', 52" in this zone. Experience has indeed shown that for preventing transverse cracks in an intrados flange tip 28', 28" during straightening of the beam blank strand 24 it is already sufficient if only an intrados boundary zone of 10 mm to 20 mm recovers a good hot ductility before straightening of the beam blank strand 24. In other words, the quenched zone 52', 52" below the heat treated zone 60', 60" may maintain a relatively low ductility without generating transverse cracks in the intrados flange tips 28', 28" during straightening of the beam blank strand 24. This result may be explained in that a thin ductile outer shell 60', 60", which extends to the outer edge 62', 62" of the flange 16', 16", is sufficient to prevent initial starting of transverse cracks. This knowledge is rather important, because it allows to conclude that the external energy supply should in particular be focused on the outer edge 62', 62" of the intrados flange tip 28', 28", and that the useful penetration depth of the heat treatment need only be of 10 mm to 20 mm. Consequently, only a relatively small heating capacity is required, and surface temperatures can be maintained below 1000° C.

Referring now to FIG. 2 a first embodiment of the heating device 44 will be described. This heating device 44 comprises a heat insulating hood 80, which is provided with a refractory lining 81 and covers the intrados side 32 of the beam blank strand 24. Two gas burner rails 82', 82"—one for reheating the left intrados flange tip 28' and one for reheating the right intrados flange tip 28"—are integrated in this hood 80. Each of these gas burner rails 82', 82" comprises a plurality of burner nozzles 84', 84", which are aligned along the intrados flange tip 28', 28" and designed so as to focus their flames onto the intrados border surface 56', 56" near the outer edge of the respective flange tip 28', 28".

Figure 3:
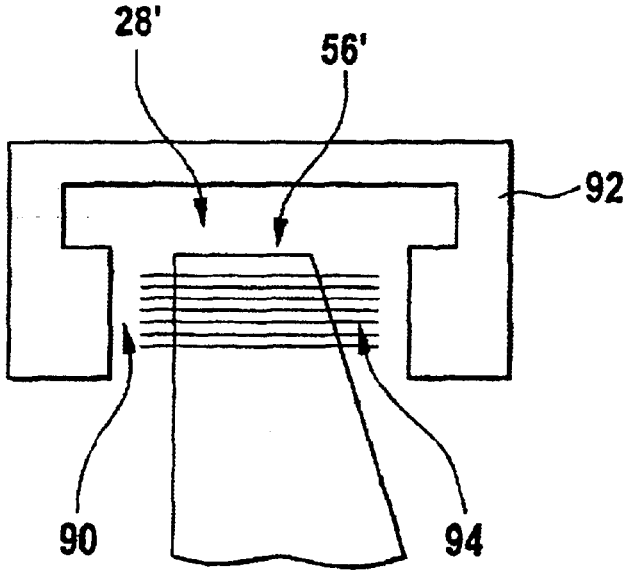
FIG. 3: is a schematic section showing a first type of an electromagnetic inductor for selectively heating an intrados flange tip of a beam blank.
Figure 4:
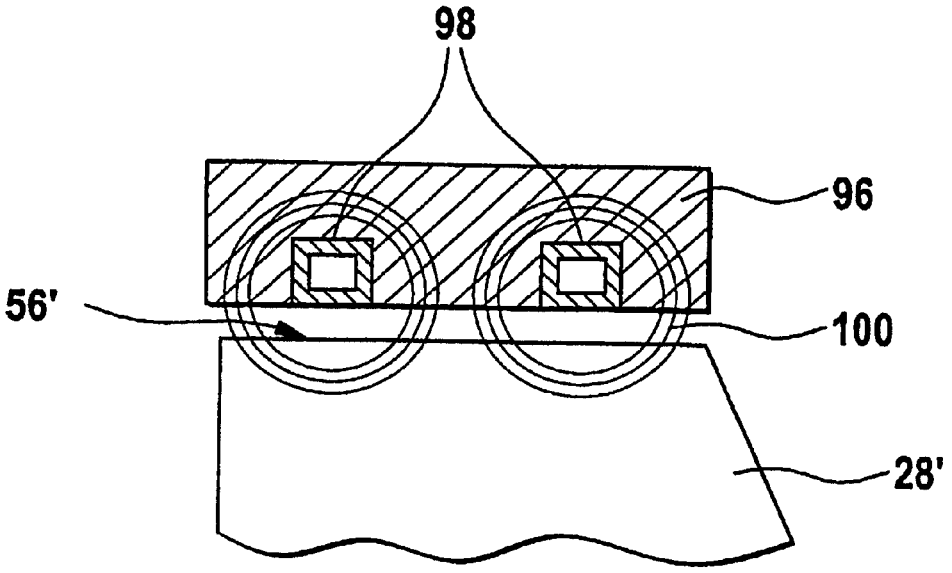
FIG. 4: is a schematic section showing a second type of an electromagnetic inductor for selectively heating an intrados flange tip of a beam blank.

FIG. 3 and FIG. 4 illustrate inductive heating of an intrados flange tip 28'. In the embodiment of FIG. 3 the flange tip 28' is arranged in an air gap 90 of a water-cooled electromagnetic inductor 92, which generates an alternating magnetic field 94 that is substantially parallel to the intrados border surface 56' of the flange tip 28'. This alternating magnetic field induces eddy currents in the flange tip 28' located in the air gap 90, causing this flange tip to be reheated. In the embodiment of FIG. 4, a water-cooled electromagnetic inductor 96 is arranged parallel to the intrados border surface 56' of the flange tip 28'. Water cooled conductors 98 generate an alternating magnetic field 100 that penetrates through the intrados border surface 56' into the flange tip 28', causing it to become heated. Heat conduction warrants a deeper penetration of the thermal energy produced by the eddy currents within a small boundary layer under the intrados border surface 56' of the flange. Depending on the temperature to be reached and the magnetic properties of the steel of the beam blank (inter alia its Curie point), it may be necessary to subdivide the electromagnetic inductor 92, 96 into several units, each unit being supplied with a current of different frequency, so as to achieve different penetration depths.

The heating device 44 should preferably be arranged between the secondary cooling zone 26 and the extracting and straightening unit 38; i.e. before the first extractor $\mathbf{38}_1$. If however, in an existing casting line, there is not sufficient place before the first extractor $\mathbf{38}_1$, it is also possible to arrange the heating device 44 between the first extractor $\mathbf{38}_1$ and the second extractor $\mathbf{38}_2$, respectively to divide it into two units, one being arranged before the first extractor $\mathbf{38}_1$, the other being arranged between the first extractor $\mathbf{38}_1$ and the second extractor $\mathbf{38}_2$. It is of course also possible to arrange a heating unit upstream of each extractor $\mathbf{38}_1$.

What is claimed is:

1. A method for producing a steel beam blank, comprising steps of:

continuously casting a steel beam blank strand with an H-shaped cross-section having a central web between two lateral flanges;

cooling said steel beam blank strand in a secondary cooling zone, wherein said steel beam blank strand is guided in a vertical casting plane along a curved path having its web perpendicular to said vertical casting plane, so that each of said lateral flanges has an intrados flange tip and an extrados flange tip, each of said intrados flange tips presenting an intrados border surface;

straightening said steel beam blank strand behind said secondary cooling zone; and providing an external energy supply to said flanges between said cooling in said secondary cooling zone and said straightening of said steel beam blank strand, wherein said external energy supply is focused on each of said intrados flange tips on a boundary zone immediately beneath said intrados border surface, so as to selectively reheat said boundary zone before said straightening of said steel beam blank strand.

2. The method as claimed in claim 1, wherein:

said external energy supply is determined so as to obtain reheating temperatures higher than 650° C., preferably higher than 800° C., in said boundary zone up to a depth of 10 mm to 20 mm beneath said intrados border surface.

3. The method as claimed in claim 2, wherein:

said external energy supply is determined so as not to exceed temperatures of 1000° C. within said reheated boundary zones.

4. The method as claimed in claim 2, wherein:

said straightening of said beam blank takes place when said reheated boundary zones still have temperatures higher than 650° C.

5. The method as claimed in claim 1, wherein:

said external energy supply is determined so as to obtain in said reheated boundary zones a fine grained ferrite-pearlite structure with a thickness of about 10 mm to 20 mm.

6. The method as claimed in claim 1, wherein:

said external energy supply is achieved by burner means comprising a plurality of burner nozzles aligned along said intrados flange tips.

7. The method as claimed in claim 1, wherein:

said external energy supply is achieved by inductor means arranged along said intrados flange tips, said inductor means inducing eddy currents in said intrados flange tips.

8. The method as claimed in claim 7, wherein:

said inductor means is located above said intrados border surface and generates an alternating magnetic field penetrating through said intrados border surface into said flange tips.

9. The method as claimed in claim 7, wherein:

said inductor means defines an air gap, and said intrados flange tip is located within said air gap in a transverse alternating magnetic field.

10. The method as claimed in claim 1, wherein:

said selective heating of said boundary zones takes place under a heat insulating hood.

* * * * *